US010794260B2

(12) United States Patent
Lee et al.

(10) Patent No.: US 10,794,260 B2
(45) Date of Patent: Oct. 6, 2020

(54) COOLANT PUMP FOR VEHICLE, COOLING SYSTEM PROVIDED WITH THE SAME AND CONTROL METHOD FOR THE SAME

(71) Applicants: Hyundai Motor Company, Seoul (KR); Kia Motors Corporation, Seoul (KR)

(72) Inventors: Hyo Jo Lee, Suwon-si (KR); Woo Yeol Jung, Hwaseong-si (KR); Tae Man Chung, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 97 days.

(21) Appl. No.: 16/193,350

(22) Filed: Nov. 16, 2018

(65) Prior Publication Data

US 2019/0323413 A1 Oct. 24, 2019

(30) Foreign Application Priority Data

Apr. 23, 2018 (KR) ..... 10-2018-0046658

(51) Int. Cl.
*F01P 5/12* (2006.01)
*F01P 7/14* (2006.01)

(52) U.S. Cl.
CPC *F01P 5/12* (2013.01); *F01P 7/14* (2013.01); *F01P 2007/146* (2013.01); *F01P 2037/02* (2013.01)

(58) Field of Classification Search
CPC ..... F01P 5/12; F01P 2007/146; F01P 2037/02
USPC ..... 123/41.09
See application file for complete search history.

(56) References Cited

U.S. PATENT DOCUMENTS

| | | | | |
|---|---|---|---|---|
| 7,722,746 | B1 * | 5/2010 | Eyal | C02F 1/46109 204/228.6 |
| 2004/0083711 | A1 * | 5/2004 | Hodinot | F02C 9/263 60/39.281 |
| 2010/0006044 | A1 * | 1/2010 | Duley | F01P 5/12 123/41.02 |
| 2012/0204819 | A1 * | 8/2012 | DiPaola | F01P 7/165 123/41.08 |
| 2018/0038268 | A1 * | 2/2018 | Kloft | F01P 11/04 |
| 2019/0345868 | A1 * | 11/2019 | Bauer | F01P 7/164 |

* cited by examiner

*Primary Examiner* — Joseph J Dallo
*Assistant Examiner* — Yi-Kai Wang
(74) *Attorney, Agent, or Firm* — Morgan, Lewis & Bockius LLP

(57) ABSTRACT

A coolant pump for a vehicle may include an impeller mounted at one side of a shaft and pumping a coolant, a pulley mounted at the other side of the shaft and receiving a torque, a pump housing of which an outlet for the coolant to flow out therethrough is formed thereto, an inflow portion including a first inlet and a second inlet configured for receiving coolant, a slider of which a first closing portion selectively closing or opening the outlet and a second closing portion selectively closing or opening the second inlet are formed thereto, and the slider disposed slidable along longitudinal direction of the shaft and a driver moving the slider.

20 Claims, 6 Drawing Sheets

COOLANT PUMP FOR VEHICLE, COOLING SYSTEM PROVIDED WITH THE SAME AND CONTROL METHOD FOR THE SAME

CROSS-REFERENCE TO RELATED APPLICATION

The present application claims priority to Korean Patent Application No. 10-2018-0046658 filed on Apr. 23, 2018, the entire contents of which is incorporated herein for all purposes by this reference.

BACKGROUND OF THE INVENTION

Field of the Invention

The present invention relates to a coolant pump, a cooling system provided with the same and a control method for the same. More particularly, the present invention relates to a coolant pump, a cooling system provided with the same and a control method for the same for a vehicle for improving a warm-up performance and a cooling performance and reducing a number of a thermostat.

Description of Related Art

An engine discharges thermal energy while generating torque based on combustion of fuel, and a coolant absorbs thermal energy while circulating through an engine, a heater, and a radiator, and releases the thermal energy to the outside.

When a temperature of the coolant of the engine is low, viscosity of oil may increase to increase frictional force and fuel consumption, and a temperature of an exhaust gas may increase gradually to lengthen a time for a catalyst to be activated, which degrades quality of the exhaust gas. Furthermore, as a time required for a function of the heater to be normalized is increased, a driver may feel discomfort.

When the coolant temperature is excessively high, since knocking occurs, performance of the engine may deteriorate by adjusting ignition timing to suppress the knocking. Furthermore, when a temperature of lubricant is excessively high, a viscosity is lowered such that a lubrication performance may be deteriorated.

There are some types of water pump, for example, a mechanical water pump operated proportional to a rotation speed of an engine and a variable water pump operated according to operation conditions/factors of an engine but separated from a rotation speed of an engine.

A variable water pump may enhance warm-up performance, fuel consumption, warming performance and cooling performance by controlling coolant flows.

However, even though a variable water pump is applied to a cooling system for controlling coolant flows, a mechanical or electrical thermostat is required for coolant to flow through a radiator.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a coolant pump, a cooling system provided with the same and a control method for the same configured for controlling discharging amount of coolant and controlling coolant flows flowing through a radiator.

A coolant pump for a vehicle according to an exemplary embodiment of the present invention may include an impeller mounted at one side of a shaft and pumping a coolant, a pulley mounted at the other side of the shaft and receiving a torque, a pump housing of which an outlet for the coolant to flow out therethrough is formed thereto, an inflow portion including a first inlet and a second inlet configured for receiving coolant, a slider of which a first closing portion selectively closing or opening the outlet and a second closing portion selectively closing or opening the second inlet are formed thereto, and the slider disposed slidable along longitudinal direction of the shaft and a driver moving the slider.

The slider may include a vertical portion formed perpendicular to the shaft and slidably mounted to the shaft, and the first closing portion and second closing portion may be formed perpendicular to the vertical portion.

A length of the second closing portion may be longer than a length of the first closing portion so that the outlet may be opened earlier than the second inlet when the slider moves along the longitudinal direction of the shaft.

An inlet partition selectively contacting the second closing portion for blocking coolant may be formed at the second inlet.

The second inlet may communicate with a radiator.

The driver may include a coolant delivery portion delivering a coolant transmitted from the inflow portion, a control unit exhausting the coolant transmitted from the coolant delivery portion to an outside or again transmitting the coolant to the coolant pump and a control chamber formed between the slider and the coolant pump housing and fluidically-connected to the control unit and moving the slider by the coolant transmitted from the control unit.

The coolant pump may further include a return elastic portion provided between the slider and the impeller to elastically support the slider.

The control unit may include a check valve preventing the coolant transmitted from the coolant delivery portion from being returned to the coolant delivery portion, a solenoid opening or closing the check valve and a controller configured for controlling an operation of the solenoid.

A cooling system for a vehicle according to an exemplary embodiment of the present invention may include an engine, a coolant control valve controlling coolant exhausted from the engine, at least one heat exchange element communicating with the coolant control valve, a radiator communicating with the coolant control valve, a coolant pump including an impeller mounted at one side of a shaft and pumping a coolant, a pump housing of which an outlet for the coolant to flow out therethrough is formed thereto, an inflow portion including a first inlet communicating with the at least one heat exchange element and a second inlet communicating with the radiator, a slider of which a first closing portion selectively closing or opening the outlet and a second closing portion selectively closing or opening the second inlet are formed thereto, and the slider disposed slidable along longitudinal direction of the shaft and a driver moving the slider, a vehicle operation state detecting portion including a coolant temperature sensor, an accelerator pedal sensor and a vehicle speed sensor and a controller receiving operation signals from the vehicle operation state detecting portion and controlling operations of the coolant control valve and the coolant pump.

The slider may include a vertical portion formed perpendicular to the shaft and slidably mounted to the shaft, and the first closing portion and second closing portion may be formed perpendicular to the vertical portion.

A length of the second closing portion may be longer than a length of the first closing portion so that the outlet may be opened earlier than the second inlet when the slider moves along the longitudinal direction of the shaft.

An inlet partition selectively contacting the second closing portion for blocking coolant may be formed at the second inlet.

The second inlet may communicate with a radiator.

A control method for the cooling system according to an exemplary embodiment of the present invention may include determining, by the controller, whether the vehicle operation state signals satisfy a predetermined cold driving condition and controlling, by the controller, the operation of coolant pump for the outlet and the second inlet to be closed.

The control method may further include determining, by the controller, whether the vehicle operation state signals satisfy a predetermined warm driving condition and controlling, by the controller, the operation of coolant pump for the outlet to be opened and for the second inlet to be closed.

The control method may further include determining, by the controller, whether the vehicle operation state signals satisfy a predetermined high temperature driving condition and controlling, by the controller, the operation of coolant pump for the outlet and the second inlet to be opened.

The control method may further include determining, by the controller, whether the vehicle operation state signals satisfy a predetermined extreme high temperature driving condition and controlling, by the controller, the operation of coolant pump for the outlet and the second inlet to be completely opened.

The coolant pump, the cooling system provided with the same and the control method for the same according to the exemplary embodiment of the present invention may control discharging amount of coolant and controlling coolant flows flowing through a radiator and thus a number of thermostat required to the cooling system may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
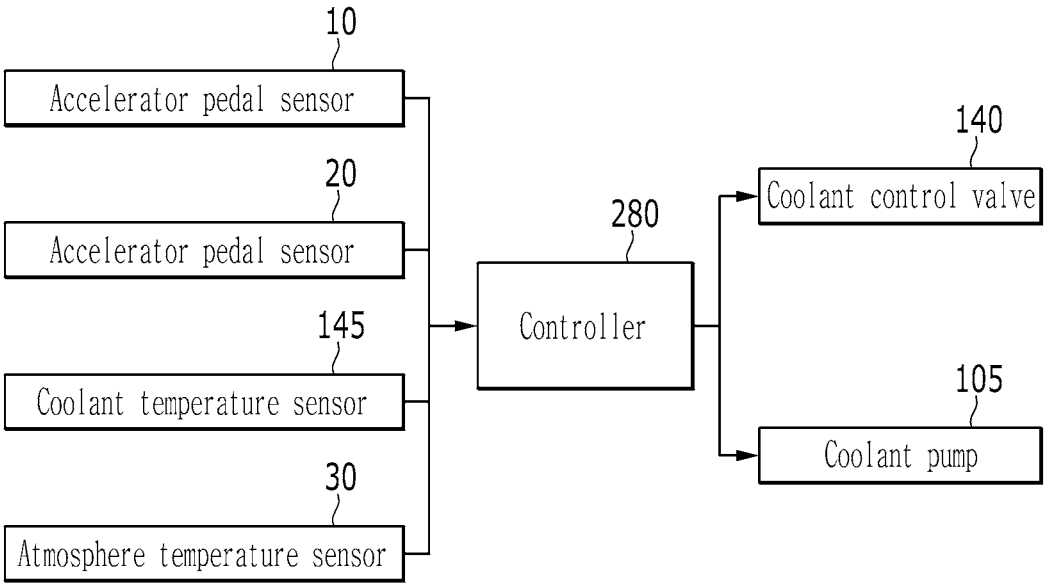
FIG. 1 is a block diagram of a cooling system provided with a coolant pump according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, various exemplary embodiments of the present invention will be described with reference to the accompanying drawings.

The sizes and thicknesses of the configurations shown in the drawings are provided selectively for the convenience of description, such that the present invention is not limited to those shown in the drawings and the thicknesses are exaggerated to make some parts and regions clear.

However, parts irrelevant to the description will be omitted to clearly describe the exemplary embodiments of the present invention, and the same or similar constituent elements will be designated by the same reference numerals throughout the specification.

In the following description, names of constituent elements are classified as a first . . . , a second . . . , and the like to discriminate the constituent elements having the same name, and the names are not necessarily limited to the order.

Figure 2:
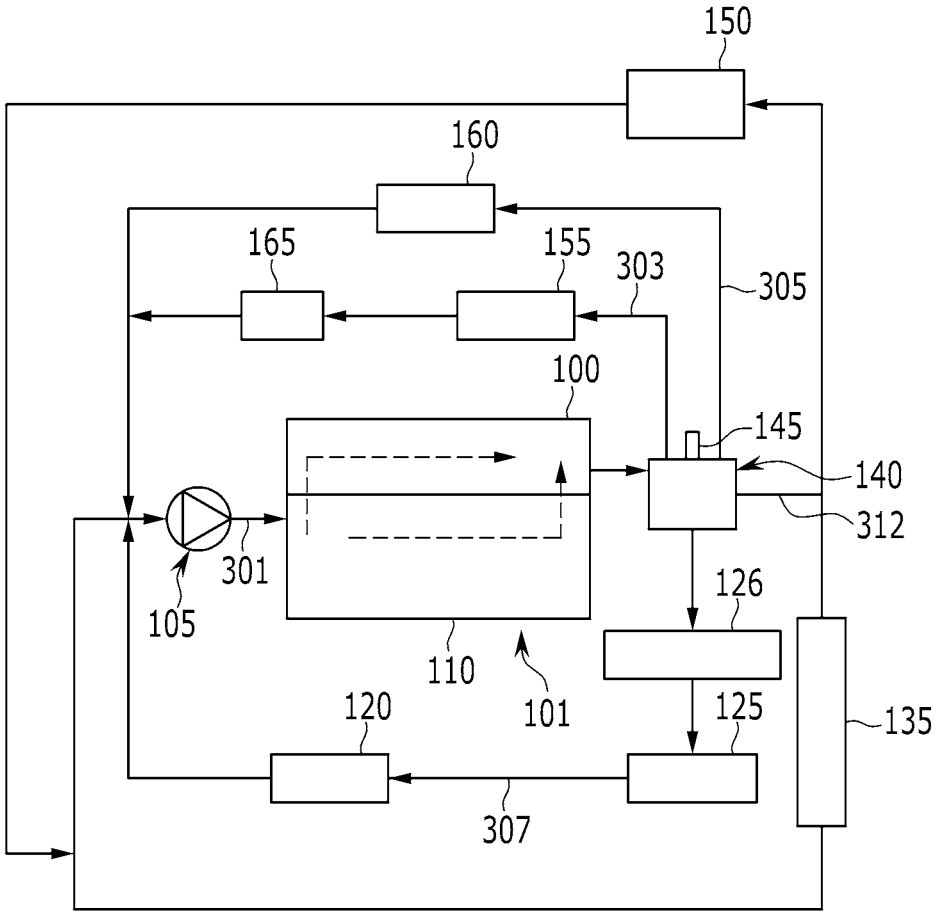
FIG. 2 is a schematic diagram of a cooling system including a coolant pump according to an exemplary embodiment of the present invention.

FIG. 1 is a block diagram of a cooling system provided with a coolant pump according to an exemplary embodiment of the present invention and FIG. 2 is a schematic diagram of a cooling system including a coolant pump according to an exemplary embodiment of the present invention.

Referring to FIG. 1 and FIG. 2, a cooling system according to an exemplary embodiment of the present invention includes an engine 101 including a cylinder block 110 and cylinder head 100, a coolant pump 105, a coolant control valve 140 and a plurality of heat exchange elements.

The coolant pump 105 is disposed near an inlet of the engine 101 and the coolant control valve 140 is disposed near an outlet of the engine 101.

In the drawing, the coolant pump 105 is connected to the cylinder block 110, and the cylinder head 100 is connected to the coolant control valve 140 so that coolant may flow from the coolant pump 105 to the cylinder block 110, the cylinder head 100 and the coolant control valve 14 sequentially. However, it is not limited thereto. The coolant pump 105 may supply coolant to the cylinder block 110 and/or the cylinder head 100 simultaneously and then to the coolant control valve 140.

The cooling system according to an exemplary embodiment of the present invention includes a vehicle operation state detecting portion and a controller 280 controls operations of the coolant pump 105 and coolant control valve 140 according to output signals of the vehicle operation state detecting portion.

The controller 280 may be implemented as one or more microprocessors operating by a predetermined program, and the predetermined program may include a series of commands for performing the exemplary embodiment of the present invention.

The vehicle operation state detecting portion may include, for example, an accelerator pedal sensor 10, a vehicle speed sensor 20, a coolant temperature sensor 145, an atmosphere temperature sensor 30 and the like.

The plurality of heat exchange elements may include, for example, a LP-exhaust gas recirculation (EGR) cooler 155, a heater 165, an EGR valve 160, a reservoir tank 150, a radiator 135, an oil cooler 125, an HP-EGR cooler 120, an ATF warmer 126 and the like.

A plurality of coolant lines is configured for connecting the cylinder block 110, the cylinder head 100, the plurality of heat exchange elements and the coolant pump 105.

The coolant control valve 140 may control coolant flows from the cylinder block 110 and the cylinder head 100 and coolant flows to the plurality of heat exchange elements. Various mechanical or electrical devices which may control coolant flows may be applied to the coolant control valve 140.

The reservoir tank 150 is connected to a coolant line connected to the radiator 135 and coolant in the reservoir tank 150 is supplied to the coolant pump 105.

The coolant temperature sensor 145 is disposed for detecting temperature flowing through the coolant control valve 140. Also, an additional coolant temperature sensor may be disposed for detecting temperature of coolant flowing through the cylinder block 110.

In the exemplary embodiment of the present invention, distribution of the coolant from the coolant control valve 140 to the plurality of heat exchange elements is not limited shown in the drawing. On the other hand, numerous exemplary variations may be available. Functions and schemes of the heat exchange elements, for example, the heater core, the radiator and the like are obvious to a person skilled in the art, thus detailed description will be omitted.

The coolant pump 105 receives coolant from the heat exchange elements and pumps.

FIG. 3, FIG. 4, FIG. 5 and FIG. 6 are cross-sectional views showing a coolant pump according to an exemplary embodiment of the present invention.

Referring to FIG. 1 to FIG. 6, the coolant pump 105 according to an exemplary embodiment of the present invention includes an impeller 230 mounted at one side of a shaft 200 and pumping a coolant, a pulley 205 mounted at the other side of the shaft 200 and receiving a torque, a pump housing 210 of which an outlet 213 for the coolant to flow out therethrough is formed thereto, an inflow portion 211 including a first inlet 212 and a second inlet 214 receiving coolant, a slider 215 of which a first closing portion 216 selectively closing or opening the outlet 213 and a second closing portion 217 selectively closing or opening the second inlet 214 are formed thereto, and the slider 215 disposed slidable along longitudinal direction of the shaft 200 and a driver 251 moving the slider 215.

The outlet 213 is communicating with one of the cylinder block 110 or the cylinder head 100, or communicating with the cylinder block 110 and the cylinder head 100, and the outlet 213 supplies the coolant to the cylinder block 110 and/or the cylinder head 100 when the outlet 213 is opened.

Coolant flowing through the radiator 135 is supplied to the second inlet 214 and coolant flowing through at least one heat exchange element of the plurality of heat exchanges excluding the radiator 135 is supplied to the first inlet 212.

The pulley 205 is mounted on one end portion of the shaft 200, and the pulley 205 receives a torque from an output shaft of the engine to rotate the shaft 200.

The impeller 230 is mounted on an external circumference of the shaft 200 and includes a rotation disk 232 of a disk shape and blades 234 formed at one surface of the rotation disk 232.

The driver 251 includes a coolant delivery portion 250 transmitting the coolant transmitted from the inflow portion 211, a control unit 290 exhausting the coolant transmitted from the coolant transmitting portion 250 to the outside or again transmitting the coolant to the coolant pump 105, and a control chamber 260 formed by the slider 215 and the coolant pump housing 210 and moving the slider 215 depending on the transmission of the coolant from the control unit 290.

A position sensor 300 detecting a position of the slider 215 and outputting a corresponding signal is internally disposed within the pump housing 210.

A coolant delivery hole 235 may be formed at the coolant pump housing 210 to communicate with the inflow portion 211 and the coolant delivery portion 250.

A return elastic portion 245 is provided between the slider 215 and the impeller 230 to elastically support the slider 215 and a supporting member 240 may be provided between the slider 215 and the impeller 230 to support the return elastic portion 245.

The control unit 290 includes a check valve 275 preventing the coolant transmitted from the coolant delivery portion 250 from being returned to the coolant delivery portion 250, a actuator 270 including a solenoid opening or closing the check valve 275, and a controller 280 controlling the operation of the actuator 270.

In an exemplary embodiment of the present invention, the coolant delivery portion 250 is connected to the control chamber 260 through a supply line 410 and a portion of the supply line 410 is connected to the check valve 275 through a bypass line 420.

In an exemplary embodiment of the present invention, the check valve 275 may include a check ball connected to the solenoid of the actuator 270 and thus the controller 280 can selectively open the check valve 275 by controlling the operation of the actuator 270.

The slider 215 includes a vertical portion 218 formed perpendicular to the shaft 215 and the first closing portion 216 and second closing portion 217 are formed perpendicular to the vertical portion 218.

A length of the second closing portion 217 is longer than a length of the first closing portion 216 so that the outlet 213 is opened earlier than the second inlet 214 when the slider 215 moves.

An inlet partition 219 selectively contacting the second closing portion 217 for blocking coolant is formed at the second inlet 214.

The second inlet 214 communicates with the radiator 135 and thus coolant cooled in the radiator 135 may be transmitted to the coolant pump 105 when the second inlet 214 is opened.

The plurality of coolant line includes an engine coolant line 301 connected to the engine 101, a radiator coolant line 312 connected to the radiator 135 and an assist coolant lines 303, 305, and 307 connected to the plurality of heat exchange elements.

The coolant control valve 140 controls coolant flows to the engine coolant line 301, the radiator coolant line 312 and the assist coolant lines 303, 305 and 307 according to control of the controller 280.

Hereinafter, referring to FIG. 1 to FIG. 6, a control method for the cooling system according to an exemplary embodiment of the present invention will be described.

In the state that the pulley 205 connected to a crankshaft is rotated, the part of the coolant transmitted to the inflow portion 211 is transmitted to the check valve 275 through the coolant delivery hole 235 and the coolant delivery portion 250.

The controller 280 determines an opening rate of the slider 215 according to signals of the vehicle operation state detecting portion including the accelerator pedal sensor 10, the vehicle speed sensor 20, the coolant temperature sensor 145 and the atmosphere temperature sensor 30 and outputs the signal corresponding to the opening rate to the actuator 270 including a solenoid, the check valve 275 is opened or closed depending on the operation of the actuator 270 including a solenoid.

If the check valve 275 is opened, the coolant transmitted through the coolant delivery portion 250 through the bypass line 420 bypasses to the discharge side and the slider 215 moves backward by the elastic force of the return elastic portion 245, that is, moves to the right in the drawing.

If the check valve 275 is closed, the coolant transmitted through the coolant delivery portion 250 is transmitted to the control chamber 260 through the supply line 410 and the slider 215 moves forward by the coolant pressure in the control chamber 260, that is, moves to the left in the drawing The controller 280 may control operations of the actuator 270 including the solenoid according to a position of the slider 215 through output signals of the position sensor 300.

Figure 3:
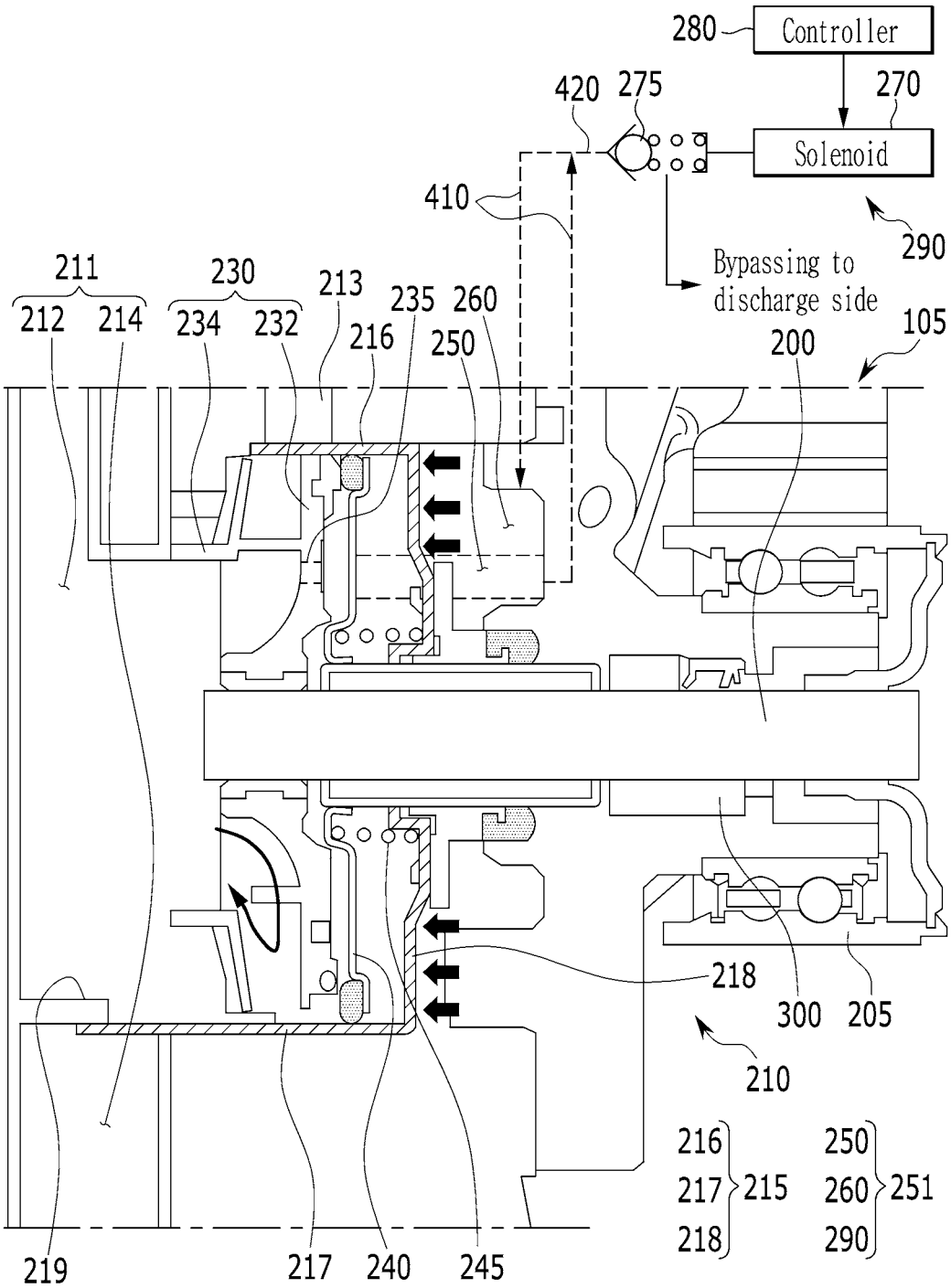
FIG. 3, FIG. 4, FIG. 5 and FIG. 6 are cross-sectional views showing a coolant pump according to an exemplary embodiment of the present invention.

The controller 280 determines whether the vehicle operation state signals satisfy a predetermined cold driving condition, and if the cold driving condition is satisfied, the controller 280 controls an operation of coolant pump 105 for the outlet 213 and the second inlet 214 to be closed as shown in FIG. 3.

The predetermined cold driving condition may be preset as the output signal of the coolant temperature sensor 145 is less than 50° C. In the instant case, the outlet 213 and the second inlet 214 are closed, so that entire flowing of the coolant stops and warm-up timing of the engine 101 may be decreased.

Figure 4:
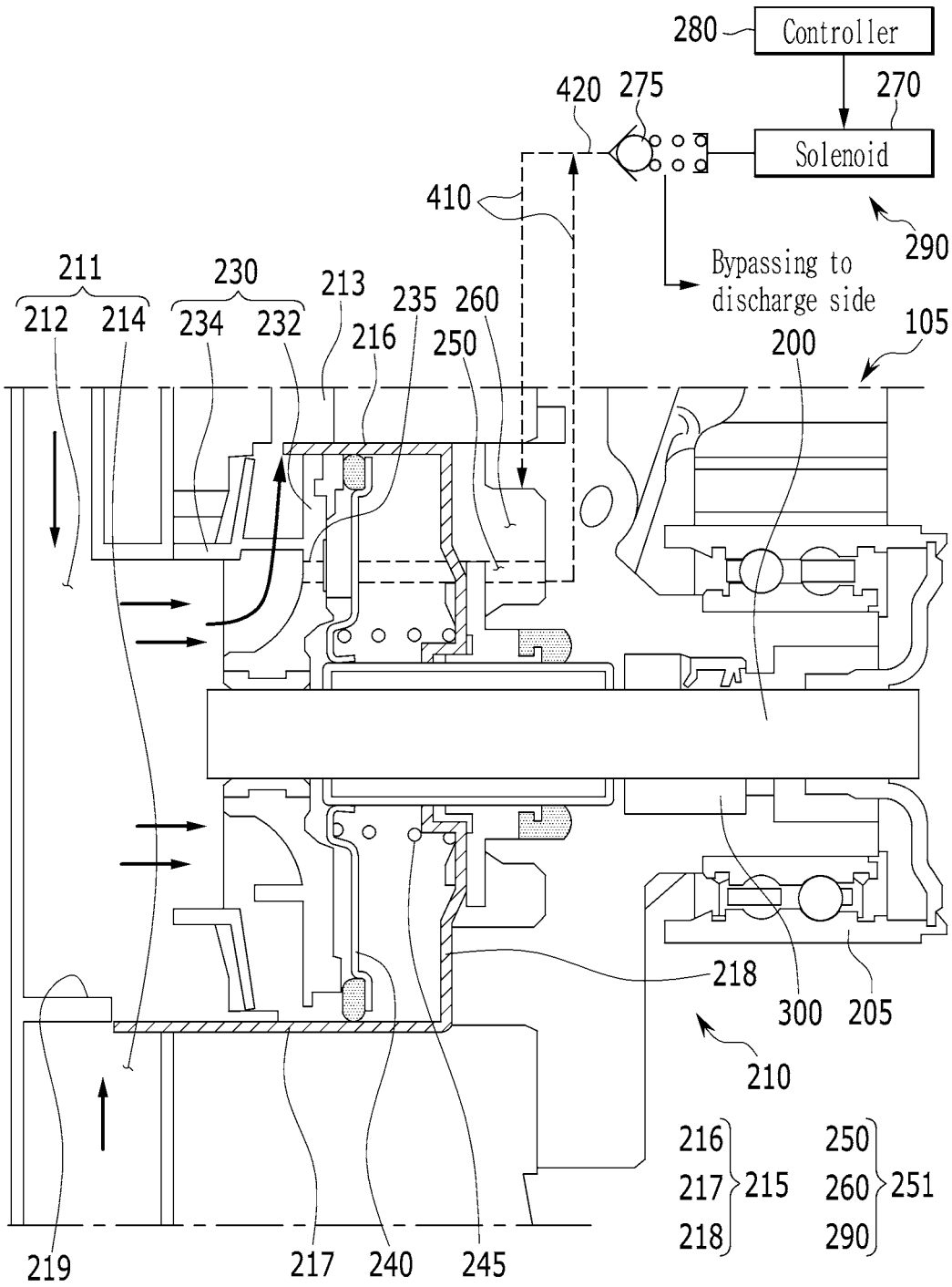

The controller 280 determines whether the vehicle operation state signals satisfy a predetermined warm driving condition and if the warm driving condition is satisfied, the controller 280 controls the operation of coolant pump 105 for the outlet 213 to be opened and for the second inlet 214 to be closed as shown in FIG. 4.

The predetermined warm driving condition may be preset as the output signal of the coolant temperature sensor 145 is between 50° C. and 90° C. and the controller 280 may control the operation of the coolant control valve 140 for supplying coolant to the plurality of heat exchange elements. In the instant case, the second inlet 214 is closed so that coolant does not flow through the radiator 135.

Figure 5:
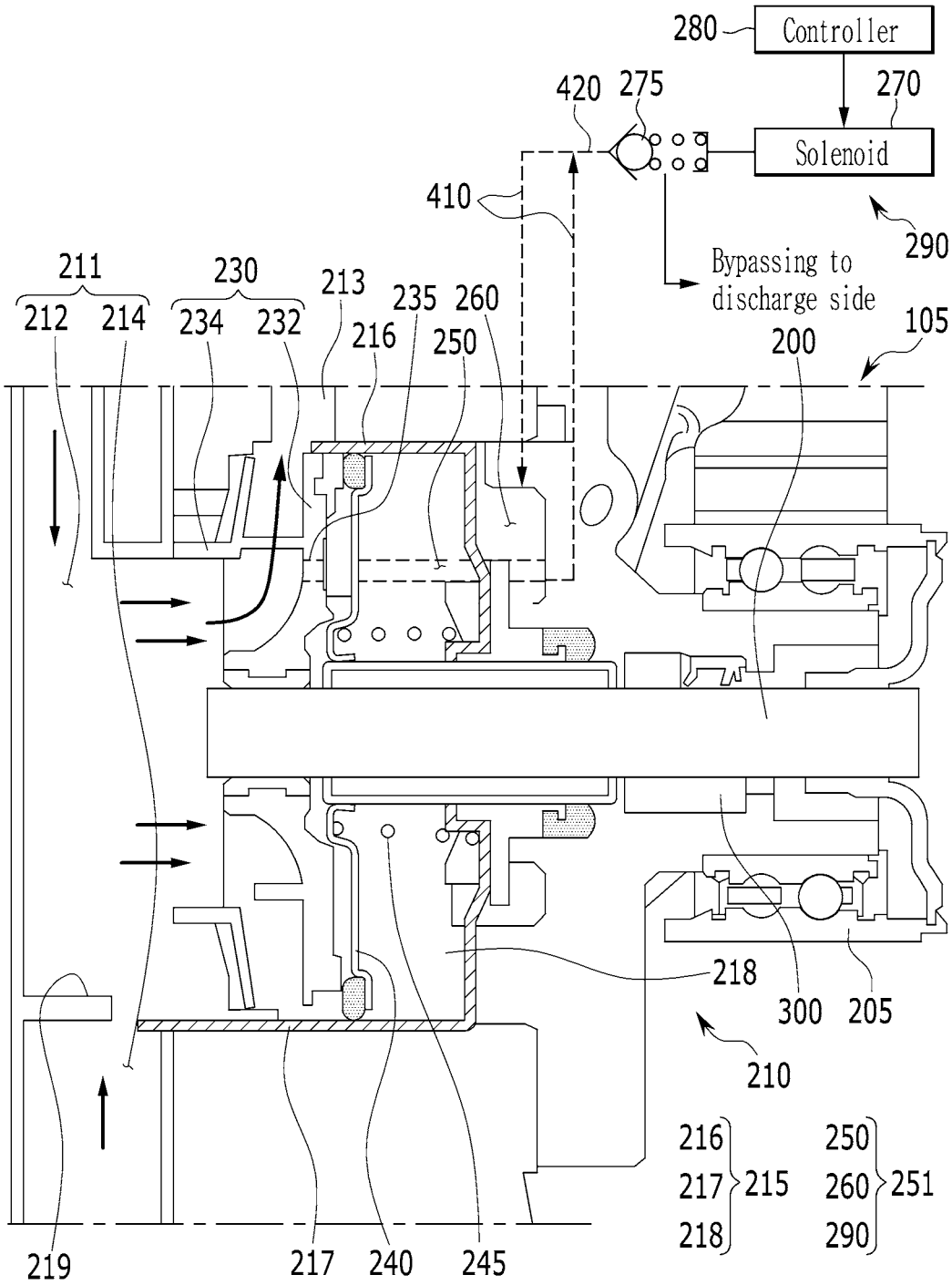

The controller 280 determines whether the vehicle operation state signals satisfy a predetermined high temperature driving condition and if the high temperature driving condition is satisfied, the controller 280 controls the operation of the coolant pump 105 for the outlet 213 and the second inlet 214 to be opened as shown in FIG. 5.

Figure 6:
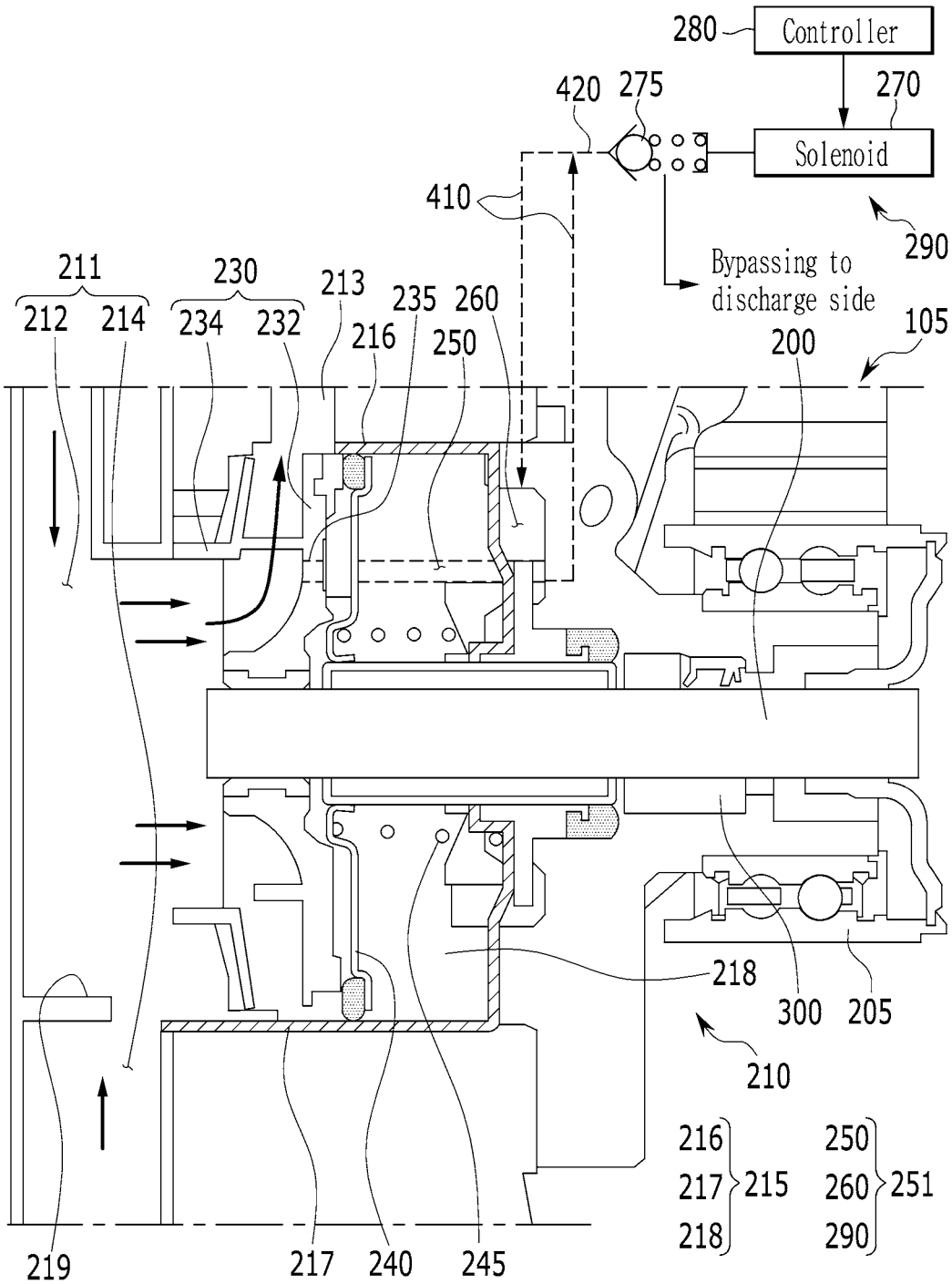

The controller 280 determines whether the vehicle operation state signals satisfy a predetermined extreme high temperature driving condition and if the extreme high temperature driving condition is satisfied, the controller 280 controls the operation of the coolant pump 105 for the outlet 213 and the second inlet 214 to be completely opened as shown in FIG. 6.

In the high temperature driving condition and the extreme high temperature driving condition, the coolant may flow through the radiator 135.

The high temperature driving condition and the extreme high temperature driving condition may be determined according to operation states of the engine.

For example, in a general driving condition, the position of the slider 215 may be controlled for maintaining the temperature of the coolant between 90° C. and 105° C. On the other hand, in a low speed/low load driving condition, the position of the slider 215 may be controlled for maintaining the temperature of the coolant between 100° C. and 115° C.

The coolant pump, the cooling system provided with the same and the control method for the same according to the exemplary embodiment of the present invention may control discharging amount of the coolant and controlling coolant flows flowing through the radiator Also, since the coolant flowing through the radiator may be controlled, so that a thermostat controlling flowing through the radiator is not required.

The coolant pump, the cooling system provided with the same and the control method for the same according to the exemplary embodiment of the present invention may reduce warm-up timing of the engine and restrain thermal shock.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A coolant pump for a vehicle, the coolant pump comprising:

an impeller mounted at a first side of a shaft and configured for pumping a coolant;

a pulley mounted at a second side of the shaft and configured for receiving a torque to rotate the shaft;

a pump housing enclosing the impeller and including an outlet for the coolant to flow out therethrough;

an inflow portion including a first inlet and a second inlet configured for receiving coolant;

a slider slidably mounted on the shaft and slidable along a longitudinal direction of the shaft, the slider including:

a first closing portion selectively opening the outlet to fluidically-connect the first inlet to the outlet; and a second closing portion selectively opening the second inlet to fluidically-connect the second inlet to the outlet; and a driver configured for moving the slider.

2. The coolant pump of claim 1, wherein the slider includes a vertical portion formed perpendicular to the shaft and slidably mounted to the shaft, and wherein the first closing portion and the second closing portion are formed perpendicular to the vertical portion and connected to the vertical portion.

3. The coolant pump of claim 2, wherein a length of the second closing portion is longer than a length of the first closing portion along the longitudinal direction of the shaft so that the outlet is opened earlier than the second inlet when the slider moves along the longitudinal direction of the shaft.

4. The coolant pump of claim 3, wherein the second inlet includes an inlet partition separating the first inlet and the second inlet, and wherein the second closing portion selectively contacts to the inlet partition for blocking coolant into the second inlet.

5. The coolant pump of claim 1, wherein the second inlet fiducially-communicates with a radiator.

6. The coolant pump of claim 1, wherein the driver includes:

a coolant delivery portion delivering a coolant transmitted from the first inlet;

a control unit exhausting the coolant transmitted from the coolant delivery portion to an outside or again transmitting the coolant to the coolant pump; and a control chamber formed between the slider and the coolant pump housing, fiducially-connected to the coolant delivery portion via a supply line, and configured for moving the slider by the coolant transmitted from the coolant delivery portion.

7. The coolant pump of claim 6, wherein a coolant delivery hole is formed at a rotation disk mounted on the shaft to fluidically-communicate with the first inlet and the coolant delivery portion.

8. The coolant pump of claim 6, further including an elastic member mounted between the slider and the impeller to elastically support the slider.

9. The coolant pump of claim 6, wherein the control unit includes:

a check valve connected to the supply line via a bypass line connecting the supply line and the check valve and configured for selectively preventing the coolant transmitted from the coolant delivery portion from being returned to the coolant delivery portion by selectively exhausting the coolant transmitted from the coolant delivery portion to the outside;

an actuator engaged to the check valve and selectively opening the check valve; and a controller connected to the actuator and configured for controlling an operation of the actuator.

10. A cooling system for a vehicle, the cooling system comprising:

an engine;

a coolant control valve configured for controlling coolant exhausted from the engine;

at least one heat exchange element fiducially-communicating with the coolant control valve;

a radiator fiducially-communicating with the coolant control valve;

a coolant pump including:

an impeller mounted at a side of a shaft and configured for pumping a coolant;

a coolant pump housing enclosing the impeller and having an outlet for the coolant to flow out therethrough;

an inflow portion having a first inlet fluidically-communicating with the at least one heat exchange element and a second inlet fluidically-communicating with the radiator;

a slider slidably mounted on the shaft and slidable along a longitudinal direction of the shaft, the slider having:

a first closing portion selectively opening the outlet to fluidically-connect the first inlet to the outlet; and a second closing portion selectively opening the second inlet to fluidically-connect the second inlet to the outlet; and a driver configured for moving the slider;

a vehicle operation state detecting portion including a coolant temperature sensor, an accelerator pedal sensor and a vehicle speed sensor; and a controller connected to the coolant control valve and the coolant pump and configured for receiving operation signals from the vehicle operation state detecting portion and for controlling operations of the coolant control valve and the coolant pump.

11. The cooling system of claim 10, wherein the slider includes a vertical portion formed perpendicular to the shaft and slidably mounted to the shaft, and wherein the first closing portion and the second closing portion are formed perpendicular to the vertical portion and connected to the vertical portion.

12. The cooling system of claim 11, wherein a length of the second closing portion is longer than a length of the first closing portion along the longitudinal direction of the shaft so that the outlet is opened earlier than the second inlet when the slider moves along the longitudinal direction of the shaft.

13. The cooling system of claim 12, wherein the second inlet includes an inlet partition separating the first inlet and the second inlet, and wherein the second closing portion selectively contacts to the inlet partition for blocking coolant into the second inlet.

14. The cooling system of claim 13, wherein the second inlet fiducially-communicates with the radiator.

15. The cooling system of claim 10, wherein the driver includes:

a coolant delivery portion delivering a coolant transmitted from the first inlet;

a control chamber formed between the slider and the coolant pump housing, fiducially-connected to the coolant delivery portion via a supply line, and configured for moving the slider by the coolant transmitted from the coolant delivery portion; and a control unit connected to the supply line via a bypass line connected to the supply line and the control unit and exhausting the coolant transmitted from the coolant delivery portion to an outside through the bypass line or again transmitting the coolant to the control chamber through the supply line.

16. The cooling system of claim 15, wherein a coolant delivery hole is formed at a rotation disk mounted on the shaft to fluidically-communicate with the first inlet and the coolant delivery portion.

17. A control method for the cooling system of claim 10, the control method including:

determining, by the controller, when the vehicle operation state signals satisfy a predetermined cold driving condition; and controlling, by the controller, the operation of the coolant pump for the outlet and the second inlet to be closed, when the vehicle operation state signals satisfy the predetermined cold driving condition.

18. The control method of claim 17, further including:

determining, by the controller, when the vehicle operation state signals satisfy a predetermined warm driving condition; and controlling, by the controller, the operation of the coolant pump for the outlet to be opened and for the second inlet to be closed, when the vehicle operation state signals satisfy the predetermined warm driving condition.

19. The control method of claim 17, further including:

determining, by the controller, when the vehicle operation state signals satisfy a predetermined high temperature driving condition; and controlling, by the controller, the operation of the coolant pump for the outlet and the second inlet to be opened, when the vehicle operation state signals satisfy the predetermined high temperature driving condition.

20. The control method of claim 17, further including:

determining, by the controller, when the vehicle operation state signals satisfy a predetermined extreme high temperature driving condition; and controlling, by the controller, the operation of the coolant pump for the outlet and the second inlet to be completely opened when the vehicle operation state signals satisfy the predetermined extreme high temperature driving condition.

* * * * *